US007785209B1

(12) United States Patent
Targosz, Jr. et al.

(10) Patent No.: US 7,785,209 B1
(45) Date of Patent: Aug. 31, 2010

(54) BILLIARD RACK

(75) Inventors: Stanley J. Targosz, Jr., West Bloomfield, MI (US); Robert A. Tertel, Plymouth, MI (US); Steve E. Long, Livonia, MI (US); Adam D. Targosz, Milford, MI (US)

(73) Assignee: RST2 International, LLC, New Hudson, MI (US)

( * ) Notice: Subject to any disclaimer, the term of this patent is extended or adjusted under 35 U.S.C. 154(b) by 509 days.

(21) Appl. No.: 11/361,861

(22) Filed: Feb. 24, 2006

Related U.S. Application Data

(60) Provisional application No. 60/656,420, filed on Feb. 25, 2005.

(51) Int. Cl.
*A63D 15/00* (2006.01)

(52) U.S. Cl. ..... 473/40; 473/21

(58) Field of Classification Search ..... 473/40, 473/21, 22, 41, 26
See application file for complete search history.

(56) References Cited

U.S. PATENT DOCUMENTS

| | | | | | |
|---|---|---|---|---|---|
| 743,464 | A | * | 11/1903 | D'Abramo | 473/40 |
| 916,193 | A | * | 3/1909 | Pierce | 473/40 |
| 952,920 | A | | 3/1910 | Meacham | |
| 1,086,254 | A | | 2/1914 | West | |
| 1,089,140 | A | | 3/1914 | Madigan | |
| 1,115,911 | A | | 11/1914 | Dickinson | |
| 1,161,324 | A | | 11/1915 | Matthay | |
| 1,725,494 | A | | 8/1929 | Vamum | |
| 3,627,321 | A | | 12/1971 | Sardo | |
| 3,992,005 | A | | 11/1976 | Richey | |
| 4,005,861 | A | | 2/1977 | Tomczak | |
| 4,452,450 | A | | 6/1984 | Cayton | |
| 4,469,328 | A | | 9/1984 | Pacitti | |
| 4,591,051 | A | | 5/1986 | Lowman | |
| 4,903,965 | A | * | 2/1990 | Smith | 473/40 |
| 4,984,788 | A | | 1/1991 | Harriman | |
| D315,942 | S | | 4/1991 | Cahill | |
| 5,376,054 | A | | 12/1994 | Kwasny et al. | |
| 5,529,540 | A | | 6/1996 | Rozek | |
| 5,531,646 | A | | 7/1996 | Boyle | |
| 5,556,341 | A | | 9/1996 | Bonn, Jr. | |
| 5,601,495 | A | | 2/1997 | Silverman | |
| 5,601,496 | A | * | 2/1997 | Beauchamp | 473/40 |
| 5,735,750 | A | | 4/1998 | Silverman | |
| 5,916,032 | A | | 6/1999 | Stoll | |
| 6,024,649 | A | | 2/2000 | Tudek et al. | |
| 6,068,558 | A | | 5/2000 | Gill et al. | |
| 6,312,342 | B1 | | 11/2001 | Newsome | |
| 6,595,862 | B2 | | 7/2003 | Porper | |
| 6,742,662 | B1 | | 6/2004 | McCormick et al. | |
| 6,932,222 | B2 | | 8/2005 | McCormick et al. | |
| 7,166,033 | B2 | * | 1/2007 | Krajeski | 473/40 |

* cited by examiner

*Primary Examiner*—Mitra Aryanpour
(74) *Attorney, Agent, or Firm*—Brooks Kushman P.C.

(57) ABSTRACT

A billiard ball rack includes a spring loaded pusher bar for accurately positioning billiards balls, and extensions on the rack provide a gripping surface for a user. The rack may include one or more adapters that permit the rack to position balls for games of three-ball, six-ball, seven-ball, eight-ball, nine-ball and ten-ball. The rack has a low profile, and therefore fits into existing storage spaces in pool tables and the like previously used for conventional racks.

23 Claims, 10 Drawing Sheets

BILLIARD RACK

CROSS-REFERENCE TO RELATED APPLICATION

This application claims the benefit of U.S. Provisional Application No. 60/656,420, filed on Feb. 25, 2005, entitled BILLIARD RACK, the entire contents of which are incorporated by reference.

BACKGROUND OF THE INVENTION

The present invention generally concerns a rack for positioning pocket billiard balls. Pocket billiards normally utilizes a plurality of standard billiard balls having a diameter of 2.250 inches±0.005 inches. The terms "billiards" and "pool" are commonly used interchangeably to describe a variety of games played on a table having a flat rectangular surface and six pockets using a plurality of standard pocket billiards/pool balls. In general, the rules and equipment such as tables and ball sizes used for pocket billiards/pool games different substantially from the tables and balls used for English billiards and snooker.

A traditional eight-ball game of pool is played on a pool table with fifteen balls including seven solids, seven stripes, an eight-ball and a cue ball. At the start of a game of eight-ball, the solids and stripes are confined in a triangularly-shaped rack. A separate diamond-shaped rack is used to play nine-ball. The billiard rack has an inner perimeter that allows all fifteen billiard balls to be placed loosely therein. Once the balls are placed inside the rack, a player typically uses his or her fingers to push the balls forward and close together so that all adjacent balls are in contact with one another. Ideally, when the rack is lifted, the balls remain uniformly and snugly packed together with all adjacent balls in contact with one another. However, oftentimes, the balls are not uniformly packed together because the player did not uniformly pack them or because the rack inadvertently contacts one or more of the balls as the rack is lifted away from the balls. Furthermore, with varying applications of force by the player's various fingers, the balls may be in close contact with adjacent balls or in no contact at all. If the balls are not properly packed, it is difficult for a player to properly break the billiard balls at the beginning of a game. In general, loose packing of the balls greatly reduces the motion of at least some balls at the break. It is also difficult to achieve consistency with the contact between each individual billiard ball in a rack. Other billiards games having differently-shaped billiard racks, such as nine-ball, suffer from the same non-uniform technique of manually packing the balls before the break.

Consequently, a billiard ball rack that uniformly applies force to the billiard balls and provides for racking different ball formations is desired.

SUMMARY OF THE INVENTION

A billiard ball rack includes a support structure defining a triangle-shaped ball-receiving space for positioning fifteen billiard balls to rack the balls for a game of eight-ball. A rear pusher bar along a rear side of the ball-receiving space is biased rearwardly by one or more resilient members such as springs or the like. One or more push rods extend rearwardly, and the support structure includes a pair of outwardly extending handles adjacent rear corners of the support structure to provide a grip for a user pushing forward on the pusher bar. The billiard ball rack includes one or more adapters configured to change the size and/or shape of the billiard ball-receiving space to rack billiard balls for games of six-ball, seven-ball, nine-ball, and ten-ball. A nine-ball adapter includes a V-shaped bar that is pivotable between a non-use position, and a use position. In the use position, the nine-ball adapter provides a diamond shaped ball-receiving space for racking nine balls for a game of nine-ball, or for racking seven balls for a game of seven-ball. In the use and/or non-use positions, the nine-ball adapter provides a low profile such that the billiard ball rack can be stored in a conventional rack storage cavity of a billiard table. The nine-ball adapter may be removed from the support structure, and a six-ball pusher bar may be installed to the support structure to provide a triangle-shaped ball-receiving space that receives six balls in a triangle configuration. A ten-ball adapter bar may be pivotably connected to the pusher bar for movement between a use position wherein the ten-ball adapter bar defines a rear side of a ball-receiving space configured to receive ten balls in a triangle formation. The ten-ball adapter bar can be pivoted to a non-use position, or it may be detached from the pusher bar.

These and other features, advantages, and objects of the present invention will be further understood and appreciated by those skilled in the art by reference to the following specification, claims, and appended drawings.

BRIEF DESCRIPTION OF THE DRAWINGS

FIG. 7 is an isometric view of the billiard ball rack of FIG. 1 showing the ten-ball pusher bar in a use position with ten billiard balls positioned in the billiard ball rack;

FIG. 9;

DETAILED DESCRIPTION OF PREFERRED EMBODIMENT

Figure 1:
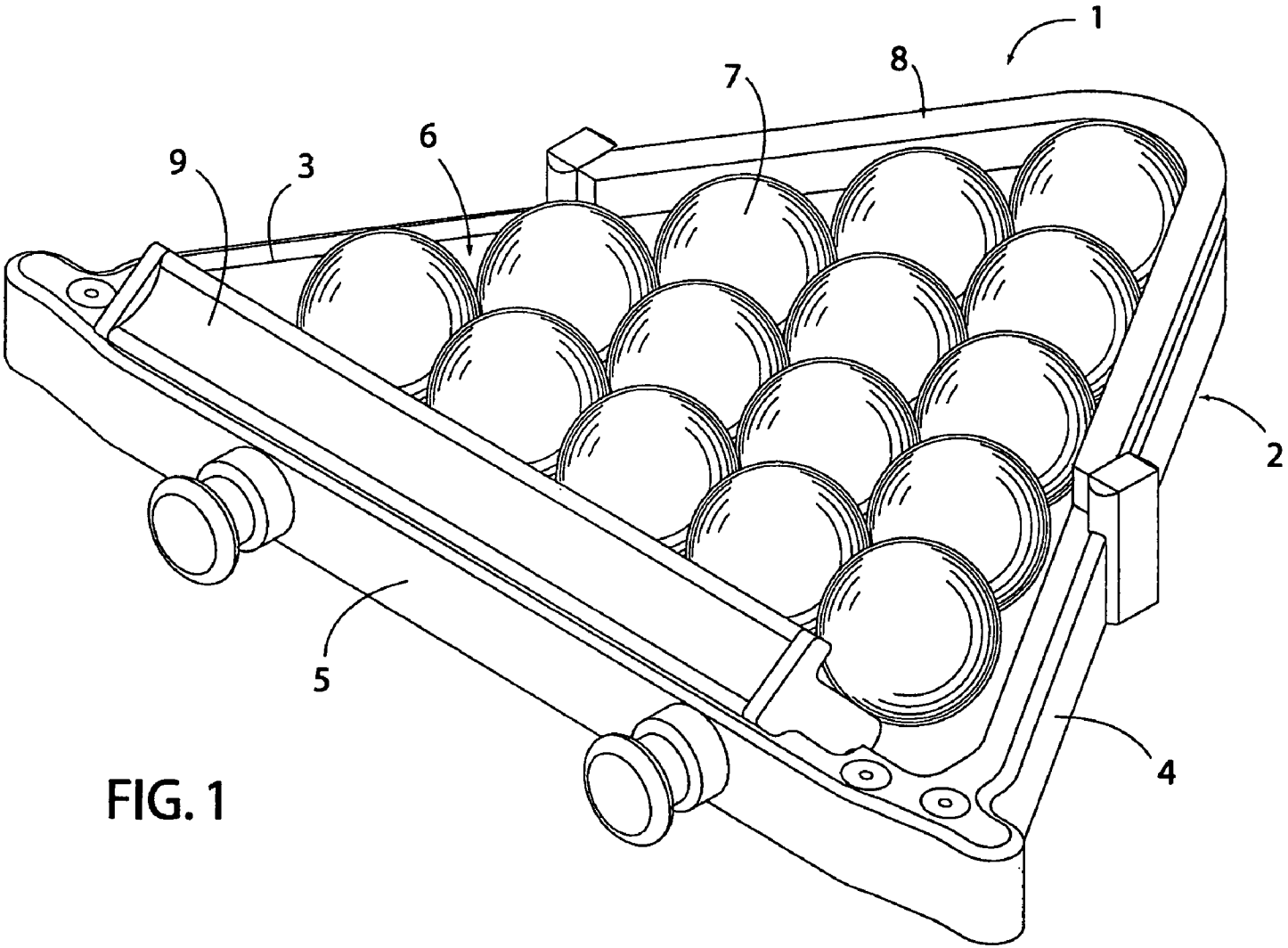
FIG. 1 is an isometric view of a billiard rack according to one aspect of the present invention wherein fifteen billiard balls are positioned in the rack.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A billiard ball rack 1 according to one aspect of the present invention is illustrated in FIG. 1. Ball rack 1 includes a support structure 2 made of a polymer or other suitable material. Support structure 2 includes first and second side members 3 and 4, and a rear member 5 that together define a ball-receiving space 6 (see also FIGS. 2 and 3) that is generally triangular in shape to receive a plurality of billiard balls 7. Although the billiard ball rack 1 may be made in a variety of sizes, in the illustrated example, the ball-receiving space 6 is sized to receive standard pocket billiard balls 7 having a diameter of about 2.25 inches. Also, as described in more detail below, the billiard ball rack 1 includes a nine-ball adapter bar 8 that allows the billiard ball rack 1 to be used for racking nine or seven billiard balls for games of nine-ball and seven-ball. Also, a ten-ball adapter bar 9 may be utilized to rack ten billiard balls 7 for games of ten-ball.

Figure 3:
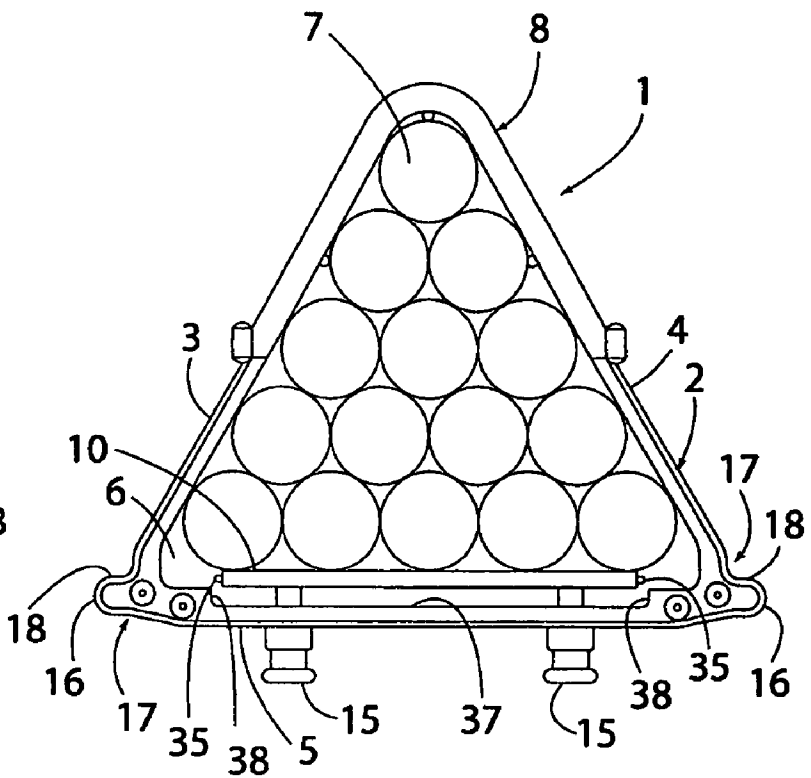
FIG. 3 is a plan view of the billiard ball rack of FIG. 1 wherein the pusher bar is in a forward position wherein it pushes against the billiard balls.
Figure 2:
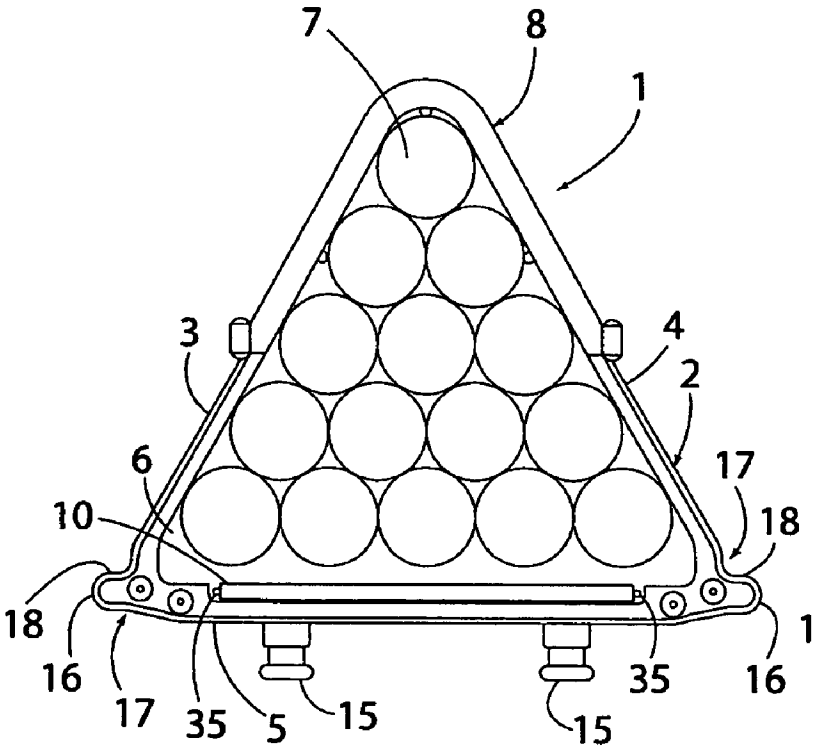
FIG. 2 is a plan view of the billiard ball rack of FIG. 1 with the pusher bar in the retracted position.

With reference to FIG. 2, billiard ball rack 1 includes a pusher bar 10 that may be shifted from a retracted position shown in FIG. 2 to a use position shown in FIG. 3 to push against fifteen pocket billiard balls 7 to thereby position the billiard balls 7 for a game of eight-ball wherein fifteen billiard balls 7 are positioned in a triangle shape. Nine-ball adapter bar 8 is removable to provide the configuration of the billiard ball rack 1 illustrated in FIGS. 2 and 3. Ball rack 1 includes a pair of push button members 15 that can be pushed forward by a user's thumb or other fingers to shift the pusher bar 10 from the rearward position illustrated in FIG. 2 forward to the position illustrated in FIG. 3. When the pusher bar 10 is in the rearward position, a gap is created between the balls 7 and the pusher bar 10. This gap is substantially larger than a gap formed in a conventional one-piece triangle-shaped ball rack. The larger gap ensures that ball rack 1 can be easily removed from around balls 7 by shifting rack 1 forward, followed by lifting rack 1 from that table surface. The support structure 2 may include a pair of protrusions 16 extending outwardly adjacent rear corner portions 17 of support structure 2. The protrusions 16 include forward surfaces 18 providing a grip surface that a user can utilize when pushing forward on push button members 15 to prevent inadvertent shifting of rack 1 on the surface of the pool table. Although pusher bar 10 could be made of many different materials, a polymer material is preferred.

Figure 4:
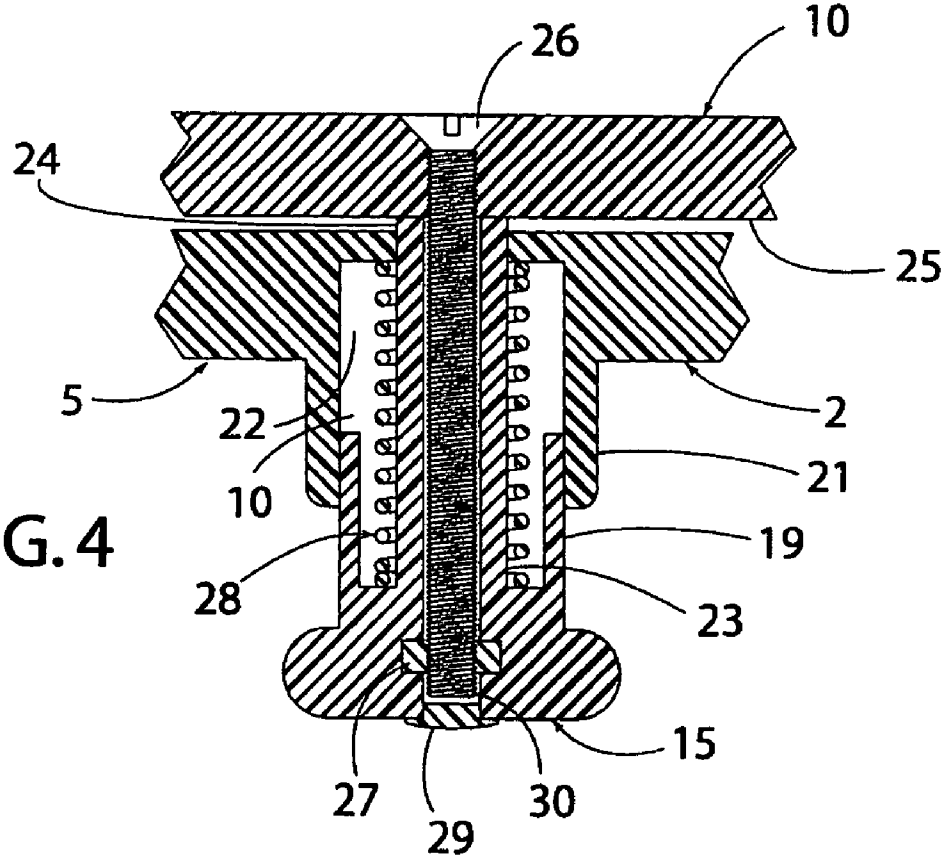
FIG. 4 is a cross-sectional view taken along the line IX-IX.
Figure 5:
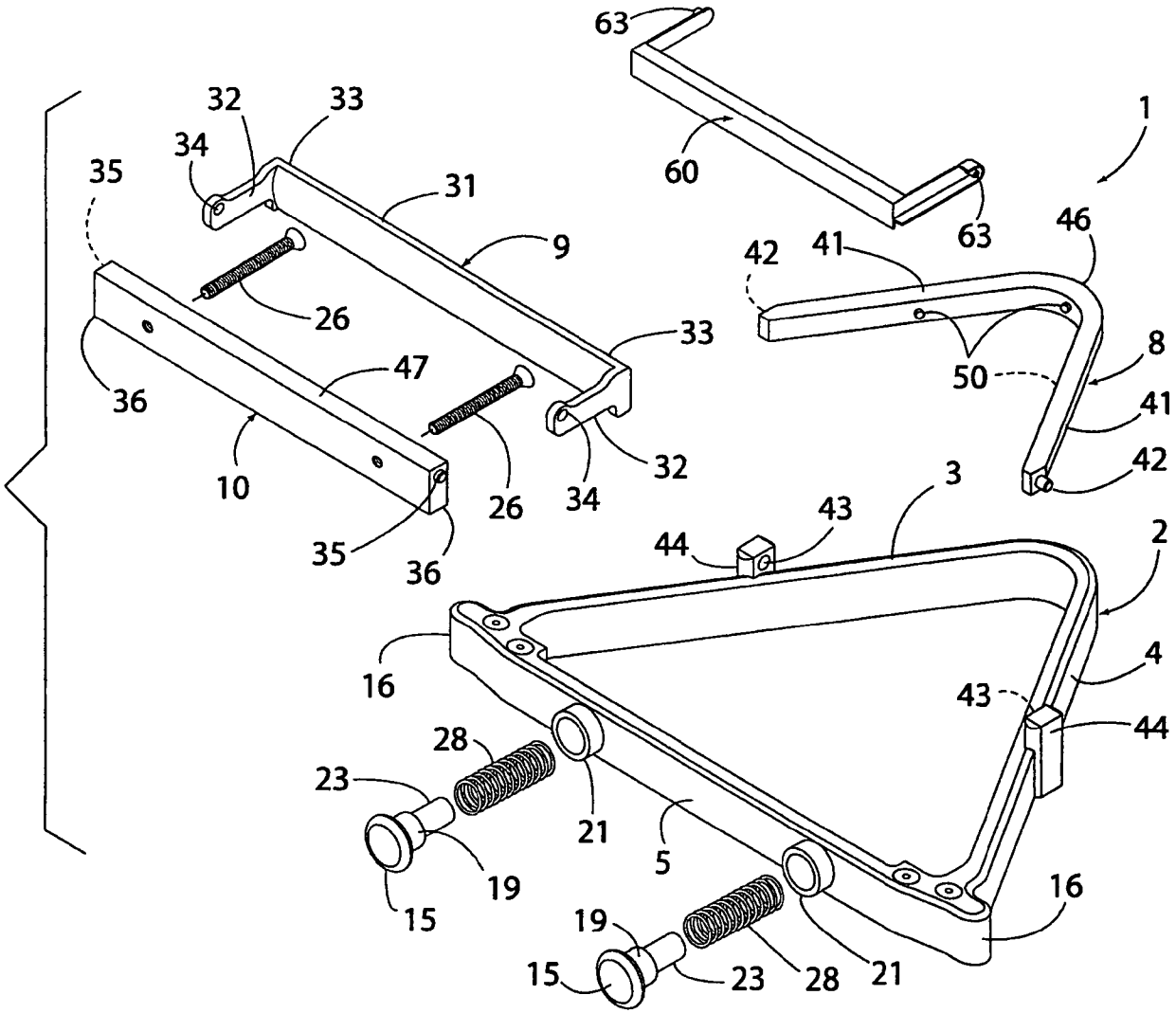
FIG. 5 is an exploded isometric view of the billiard ball rack of FIG. 1, showing adapter bars for racking ten billiard balls, nine billiard balls, seven billiard balls, six billiard balls, and three billiard balls.
Figure 7:
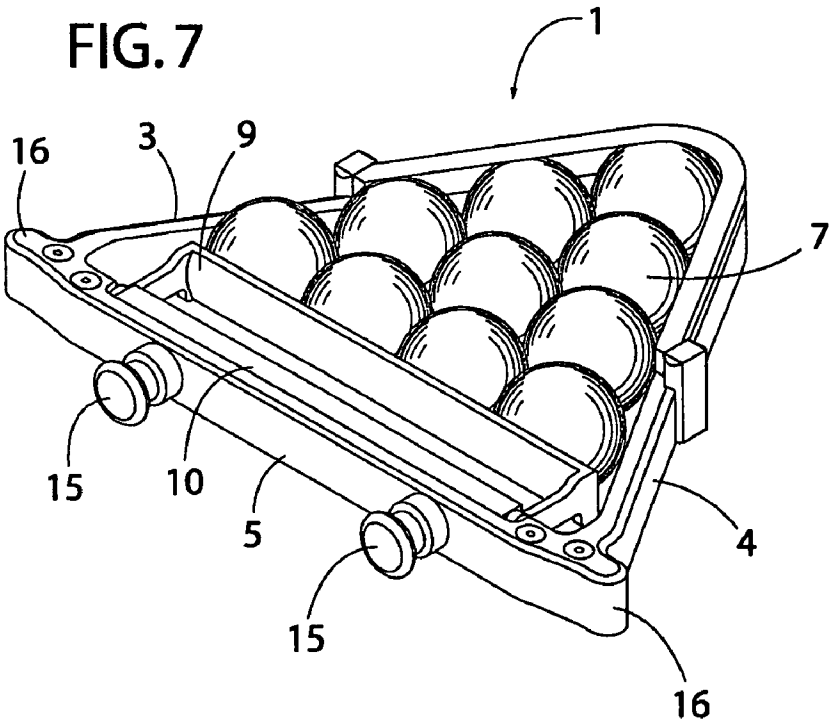
FIG. 7.
Figure 6:
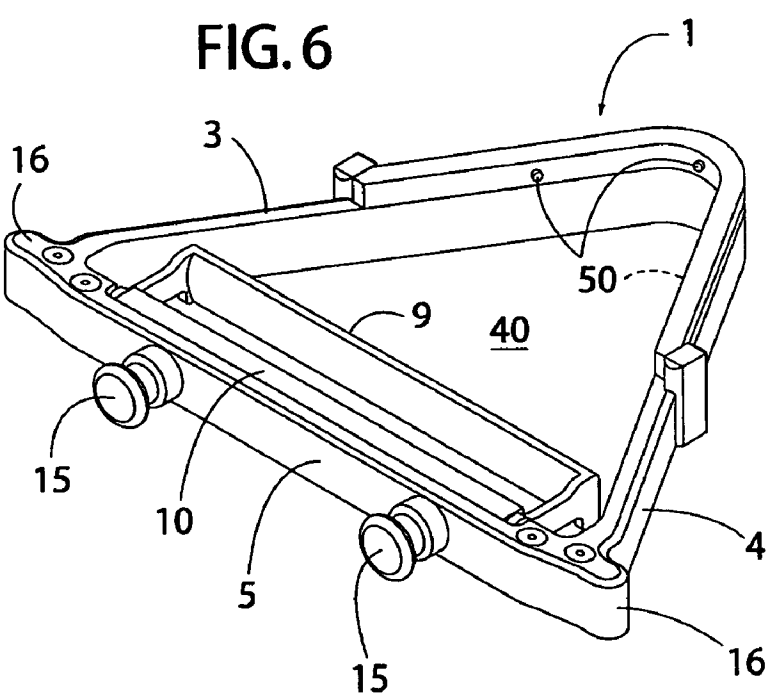
FIG. 6 is an isometric view of the billiard ball rack of FIG. 1 showing the ten-ball pusher bar in a use position.
Figure 9:
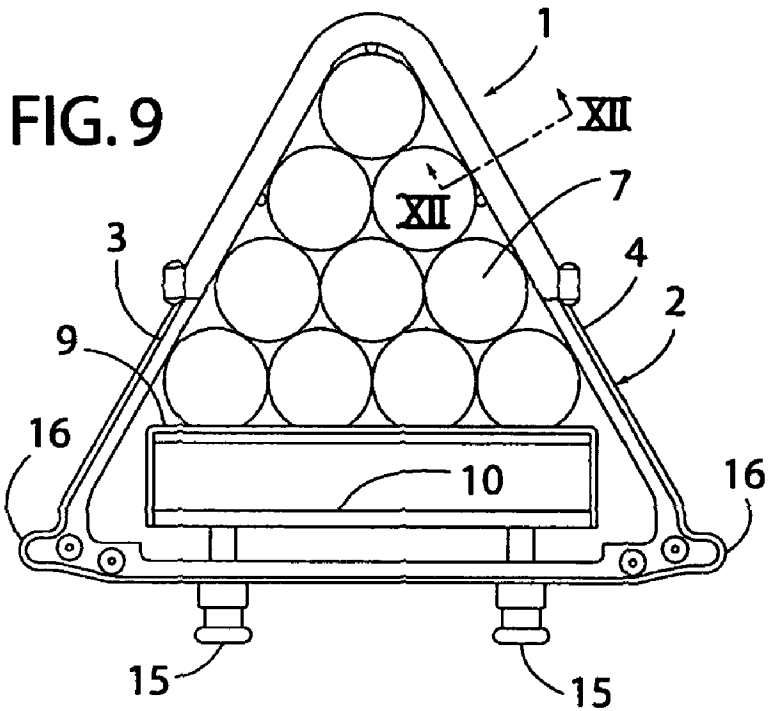
FIG. 9 is a plan view of the billiard ball rack with the ten-ball adapter bar in an engaged position.
Figure 8:
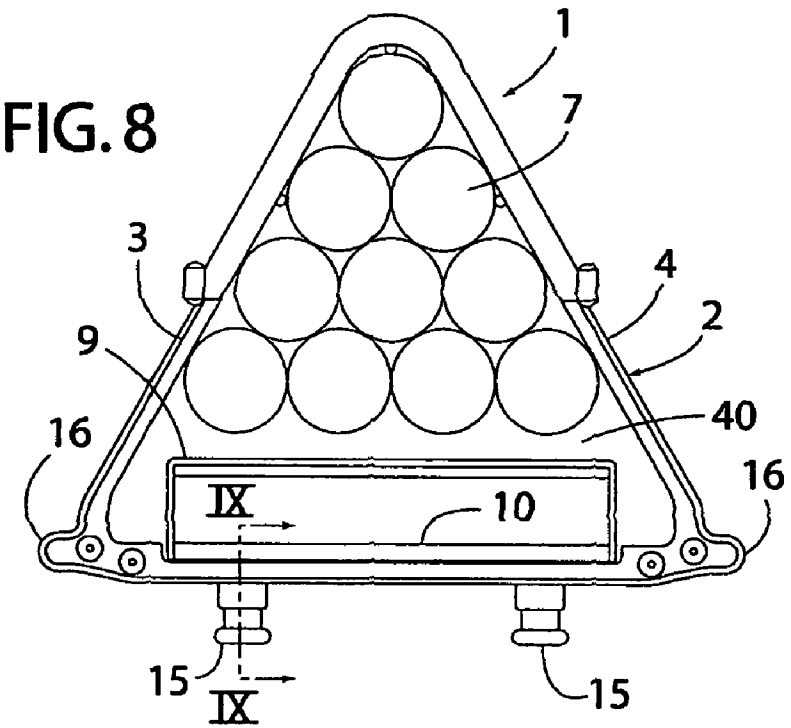
FIG. 8 is a plan view of the billiard ball rack with the ten-ball adapter bar in a disengaged position.

With reference to FIGS. 4 and 5, each pusher button member 15 is preferably made of a polymer material or the like, and includes a cylindrical wall 19 that is received in a cylindrical cavity 22 formed by rearwardly protruding cylindrical walls 21 of rear member 5 of support structure 2. An elongated inner cylindrical portion 23 of push button member 15 extends through a cylindrical opening 24 in rear member 5, and abuts side surface 25 of pusher bar 10. A screw 26 is threadably received in a nut 27 to thereby interconnect the pusher bar 10 and push button members 15. A spring 28 biases the push button members 15 outwardly, and also thereby bias the pusher bar 10 to the retracted position shown in FIG. 2. A plug 29 or the like closes off bore 30 in push button member 15 to provide a finished appearance and form a smooth surface upon which a user can push. In use, a user may position one or more fingers on the forward surfaces 18, and pushes forward against push button members 15 with his or her thumbs to thereby move pusher bar 10 forward without shifting the position of support structure 2.

With reference to FIG. 5, ten-ball adapter bar 9 includes an elongated crossbar portion 31, and a pair of arms 32 that extend transversely from the ends 33 of crossbar 31. Arms 32 include openings 34 that receive pins 35 on opposite ends 36 of pusher bar 10 to thereby pivotably connect the ten-ball adapter bar 9 to the pusher bar 10. Ten-ball adapter bar 9 is preferably made of a polymer material that is somewhat flexible, such that the arms 32 can be manually grasped and flexed apart to engage and disengage pins 35 with openings 34 to attach or detach adapter bar 9 from pusher bar 10.

With reference to FIG. 3, rear member 5 of support structure 2 includes a shallow recess 37 that receives pusher bar 10 when it is in the retracted position illustrated in FIG. 2. When pusher bar 10 is in the retracted position, adjacent pins 35 are positioned directly adjacent opposite end surfaces 38 of recess 37. If adapter bar 9 is connected to pusher bar 10 and pusher bar 10 is in the retracted position, the end surfaces 38 prevent arms 32 of adapter bar 9 from being flexed outwardly. Thus, adapter bar 9 cannot be attached or detached from pusher bar 10 unless pusher bar 10 is pushed forward away from recess 37 as illustrated in FIG. 3. The configuration of the opposite end surfaces 38 of recess 37 thereby prevent inadvertent detachment of adapter bar 9.

With reference to FIGS. 6-9, adapter bar 9 can be pivoted to a use position to define a billiard ball-receiving space 40 configured to retain ten standard billiard balls 7 in a triangle-shaped configuration for a game of ten-ball. The adapter bar 9 can be shifted forward by pushing on the push button members 15 while grasping protrusions 16.

Figure 11:
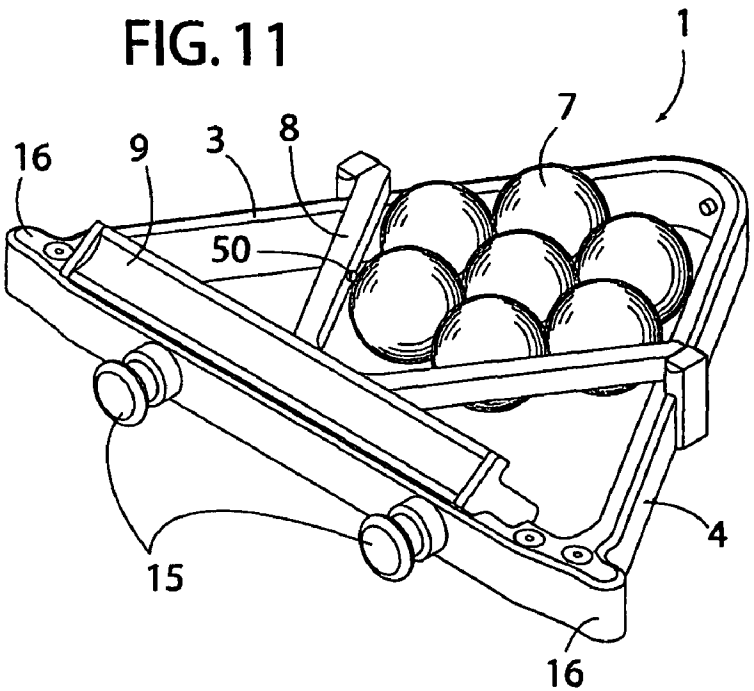
FIG. 11 is an isometric view of the billiard ball rack with the nine-ball adapter bar in a use position, with seven billiard balls in the billiard ball rack.
Figure 10:
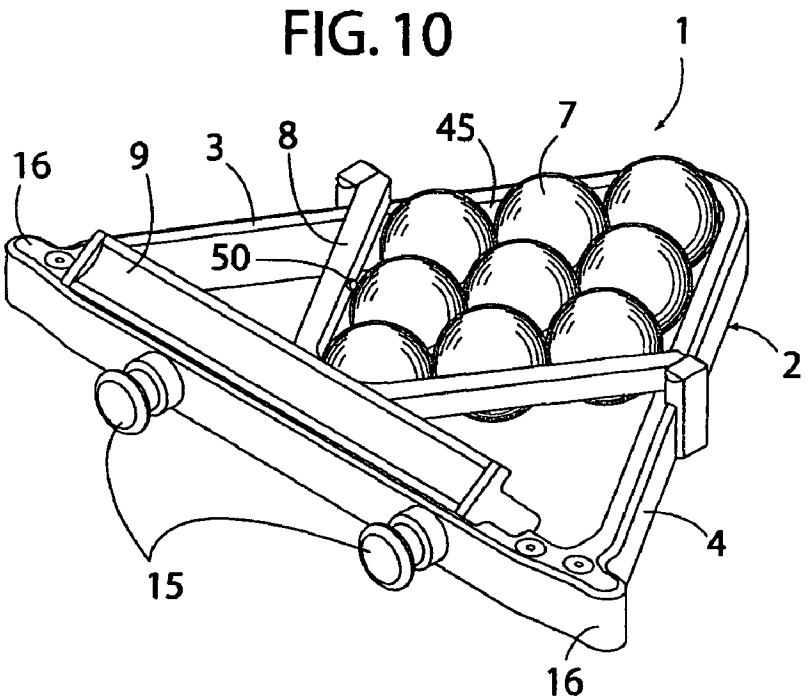
FIG. 10 is an isometric view of the billiard ball rack with the nine-ball adapter bar in a use position, with nine billiard balls in the billiard ball rack.

With further reference to FIG. 10, billiard ball rack 1 also includes an adapter bar 8 that can be flipped or rotated from a storage or non-use position (FIG. 1) to a use position as shown in FIG. 10. As shown in FIG. 5, adapter bar 8 includes a pair of arms 41 forming a V-shape, with pins 42 extending outwardly from the ends of arms 41. Pins 42 are pivotably received in openings 43 in upwardly extending portions 44 of support structure 2 to pivotably connect bar 8 to support structure 2. When the adapter bar 8 is in the use position illustrated in FIGS. 10 and 11, corner portion 46 of adapter bar 8 rests on top surface 47 (FIG. 5) of pusher bar 10. In this way, arms 41 are positioned to extend horizontally to provide a properly shaped diamond ball-receiving space 45. Adapter bar 8 is preferably made of a polymer material that is somewhat flexible, such that the arms 41 can be flexed towards one another to remove pins 42 from openings 43 to thereby remove (or install) adapter bar 8 to support structure 2. When the adapter bar 8 is in a use position illustrated in FIG. 10, the adapter bar 8 and side members 3 and 4 of support structure 2 define a diamond-shaped ball-receiving space 45 to hold nine billiard balls 7 in position for a game of nine-ball. As illustrated in FIG. 11, adapter bar 8 can also be utilized to position a group of seven billiard balls 7 for a game of seven-ball.

Figure 12:
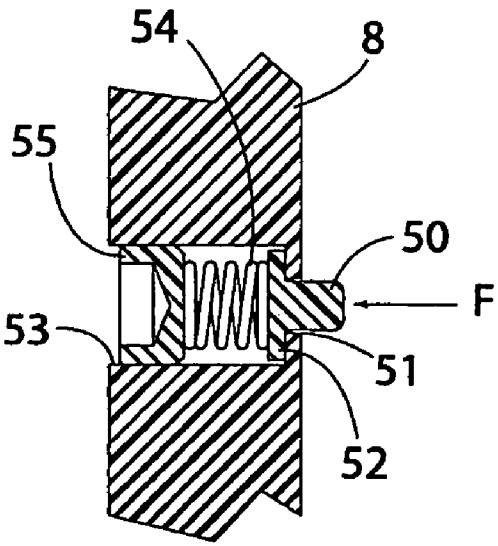
FIG. 12 is a cross-sectional view taken along the line XII-XII.

With reference to FIG. 12, billiard ball rack 1 may optionally include one or more spring loaded pins 50 extend through openings 51 in adapter bar 8. Pins 50 have a shape that is somewhat similar to a thumb tack, with a head 52 that is received in a cylindrical portion 43 of openings 51. A spring 54 is retained in cylindrical cavity 53 by an Allan head set screw 55 or the like. Rotation of set screw 55 increases or decreases the amount of preload (i.e. compression) of spring 54 to thereby adjust the amount of force "F" required to retract pin 50. Three pins 50 on adapter bar 8 push against billiard balls 7 when positioning the billiard balls 7 as illustrated in FIG. 10. When positioning seven billiard balls 7 as illustrated in FIG. 11, only two of the pins 50 contact billiard balls 7. In both configurations, the force generated by the pins 50 provides for a tightly packed ball configuration.

Figures 13, 14:
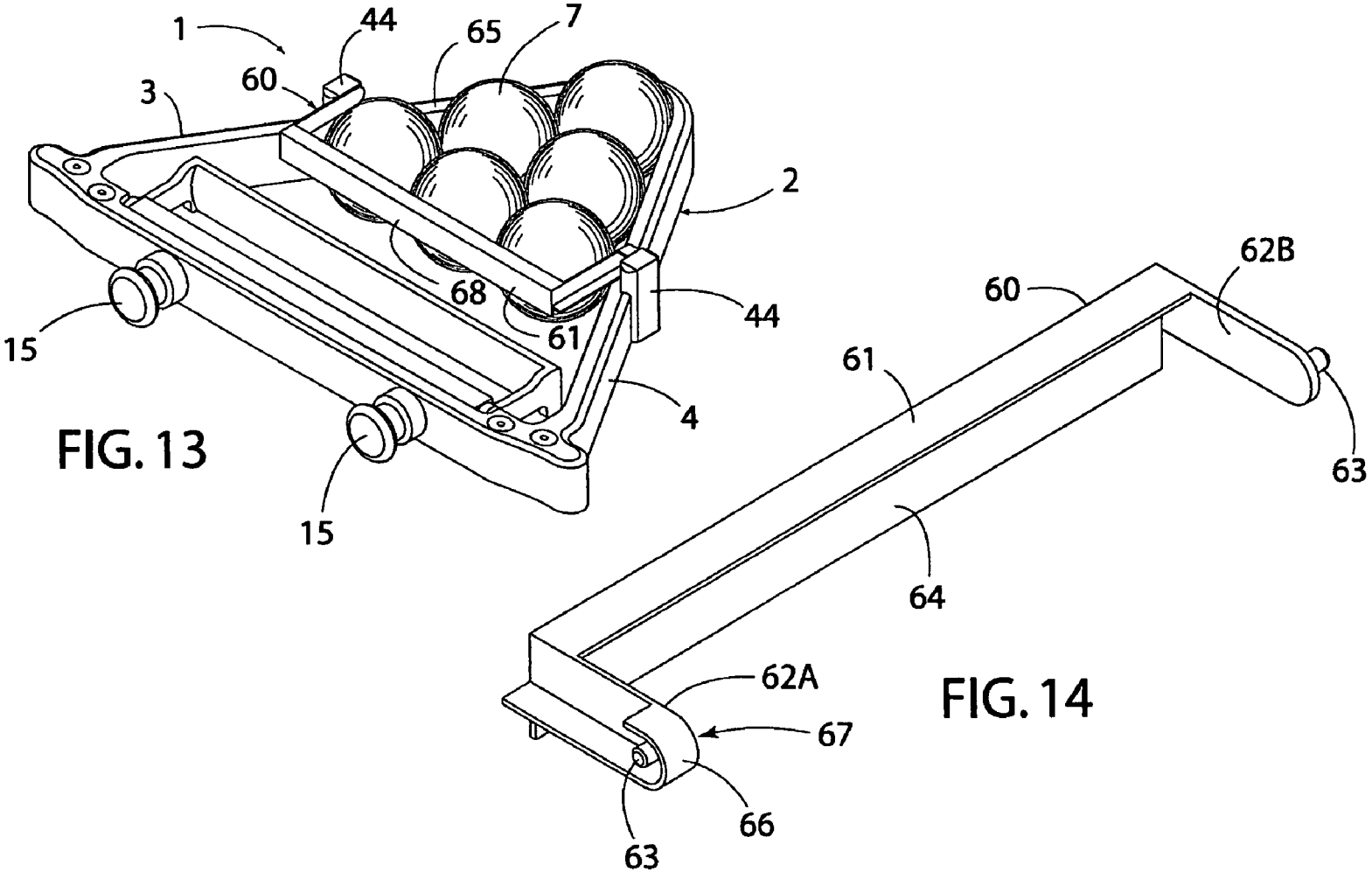
FIG. 13 is an isometric view of the billiard ball rack with a six-ball adapter bar in a use position.
FIG. 14 is an isometric view of the six-ball adapter bar of FIG. 13.

With further reference to FIGS. 13 and 14, an adapter bar 60 may be utilized to position six billiard balls 7 for a game of six-ball. Adapter bar 60 is made of a polymer material or like, includes an elongated crossbar portion 61 and a pair of transverse arms 62A and 62B having pins 63 that are received in openings 43 (FIG. 5) of support structure 2. The arms 62A and 62B are somewhat flexible, such that pins 63 can be removed or installed from openings 43 by flexing arms 62A and 62B. A forward surface 64 of crossbar 61 bears against billiard balls 7 positioned in a triangular billiard ball-receiving space 65 defined by adapter bar 6 and side members 3 and 4 of support structure 2. A J-shaped flange 66 at an end 67 of first arm 62A ensures that adapter bar 60 is installed to base structure 2 in the proper orientation. The J-shaped flange 66 interferes with upwardly extending portions 44 of base structure 2 if installation of adapter bar 60 in an improper orientation is attempted. Adapter bar 60 may be rotated about pins 63 from the position illustrated in FIG. 13 to a forward position (not shown) wherein surface 68 of crossbar portion 61 extends between side members 3 and 4 to define a triangular-shaped ball-receiving space sized to receive three billiard balls 7 for games of seven-ball.

Figure 15:
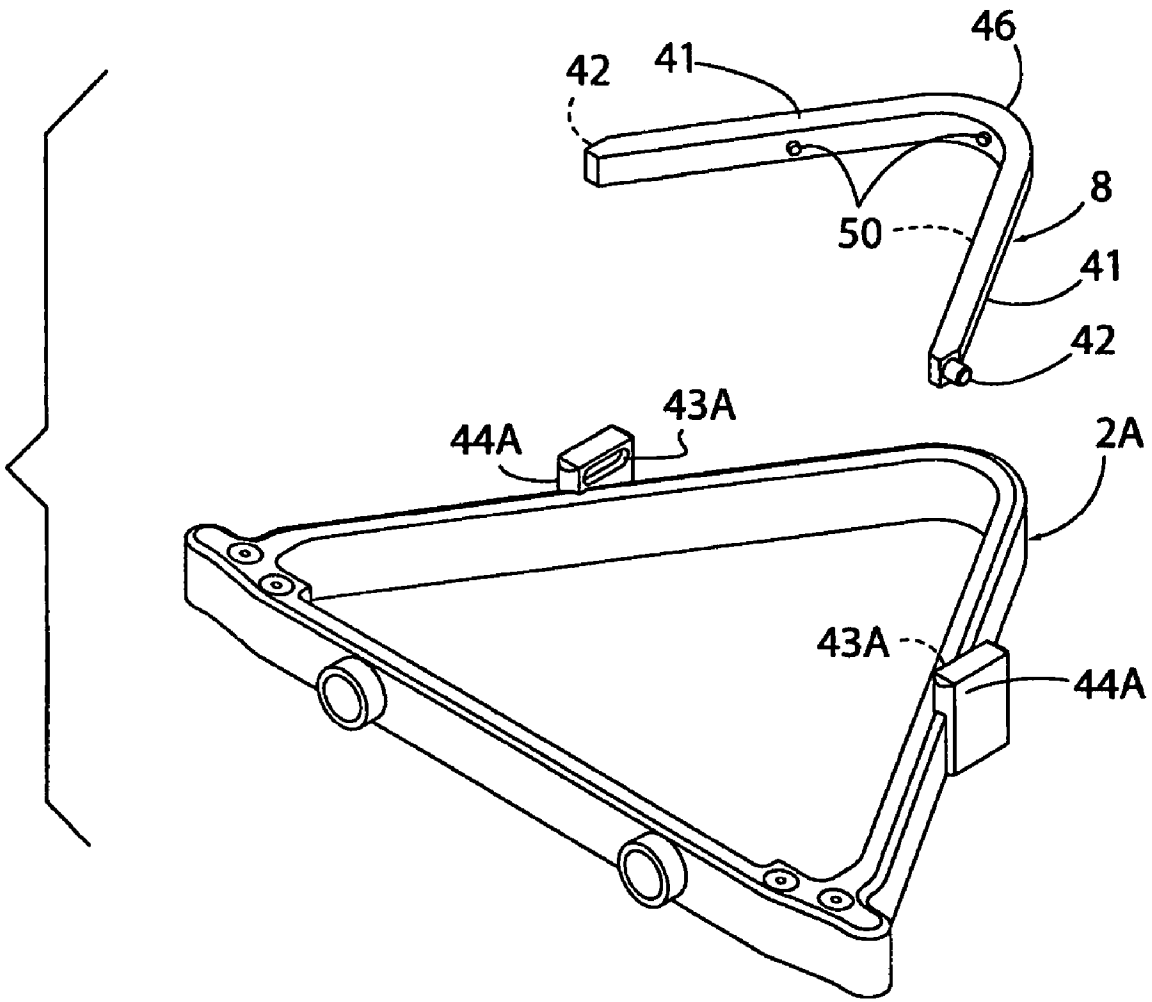
FIG. 15 is an isometric view of a billiard ball rack according to another aspect of the present invention.
Figure 16:
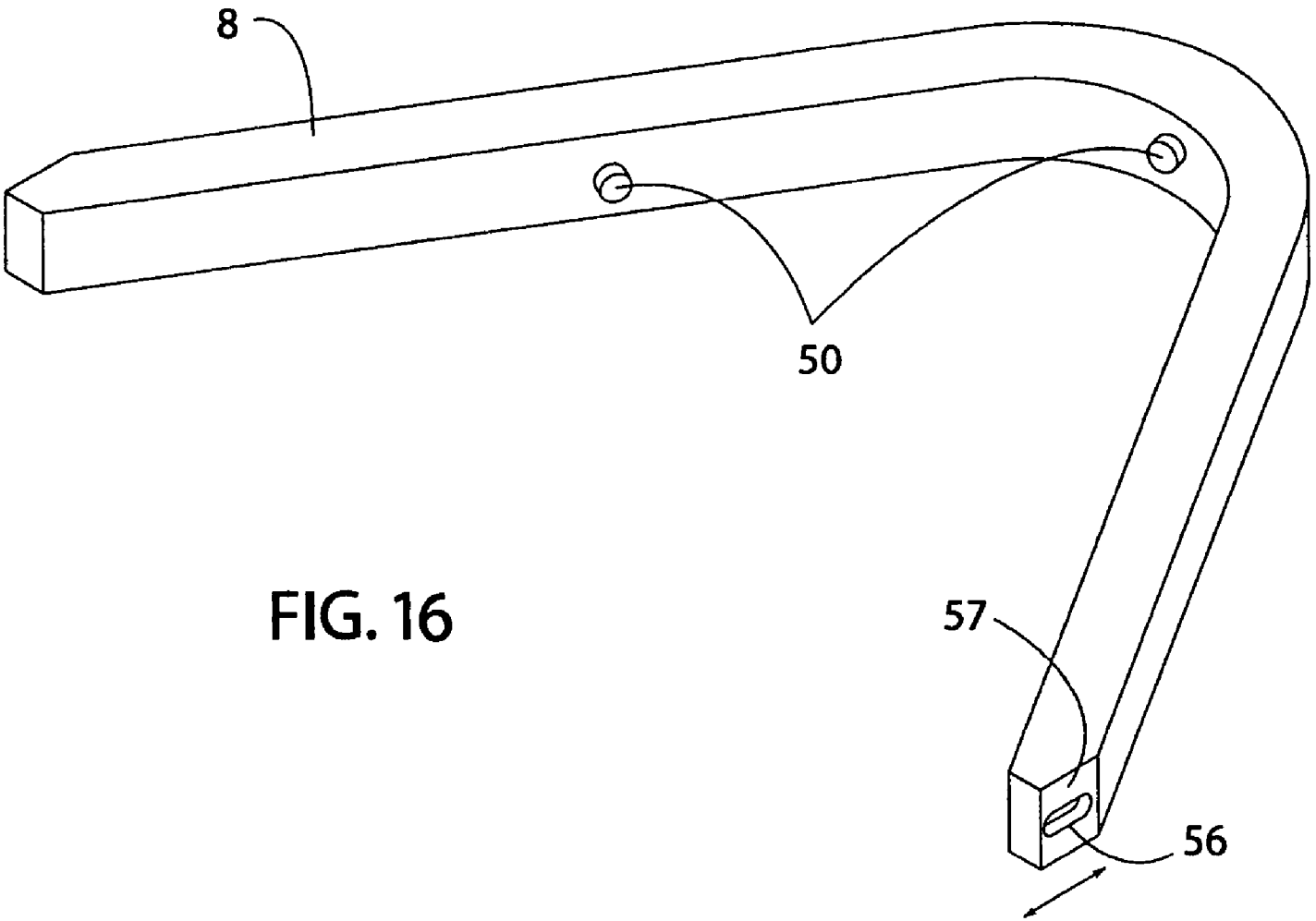
FIG. 16 is an isometric view of a nine-ball adapter bar according to yet another aspect of the present invention.

With further reference to FIG. 15, support structure 2A of ball rack 1 may include slots 43A in extensions 44A instead of openings 43 (FIG. 5) in extensions 44. Pins 42 of adapter bar 8 are received in slots 43A to provide, in addition to pivoting, fore-aft movement of adapter bar 8 for pushing on balls 7 to provide for close positioning of balls 7 in contact with one another for games of seven-ball and nine-ball. Similarly, pins 63 of adapter bar 60 are received in slots 43A to provide pivoting and fore-aft movement of adapter bar 60 to provide tight positioning of balls 7 for games of six-ball and three-ball. Also, the adapter bars 8 and 60 may be shifted rearwardly away from balls 7 after the balls 7 are positioned. The rack 1 can then be shifted forward slightly and lifted off the table surface without bumping the balls 7 and disturbing the position of the balls 7. It will be understood that various other pivotable and slidable connection arrangements may be utilized according to other aspects of the invention. For example, with reference to FIG. 16, slots 56 could be located on end faces 57 of adapter bar 8, with pins on support structure 2A. Adapter bar 60 could also have slots 56 that slidably and pivotably engage pins on the support structure 2A.

The billiard ball rack 1 of the present invention can be quickly and easily configured to provide for positioning of billiard balls in a number of different configurations for different billiard ball games. A spring-loaded pusher bar permits the balls to be tightly positioned quickly and easily, and the rack 1 has a compact, low profile design that allows the rack to be stored in conventional rack storage spaces in pool tables.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A billiard ball rack for positioning billiard balls, comprising:

a support structure having two side members and a rear member that together form a billiard ball-receiving space that is generally triangular in plan view, the two side members and rear member disposed at about sixty degrees relative to one another, the support structure including a front portion and a rear portion, the front portion having first and second inner surface portions facing the billiard ball-receiving space and having a shape that, in use, positions at least five standard billiard balls having a diameter of about two and one quarter inch diameter in a packed planar configuration wherein each billiard ball contacts at least two adjacent billiard balls;

a movable push assembly movably mounted to the support structure, wherein the push assembly is movable forward from a retracted position towards the front portion of the support structure, the push assembly having a first push surface facing the billiard ball-receiving space, the push surface having at least five contact areas shaped to simultaneously contact a row of five standard billiard balls of a group of fifteen billiard balls positioned in the billiard ball receiving space when the push assembly is positioned forward of the retracted position;

the push assembly further including a second push surface that is movable relative to the first push surface from a use position to a non-use position, the second push surface having at least four contact areas shaped to simultaneously contact a row of four standard billiard balls of a group of ten billiard balls positioned in the billiard ball-receiving space when the second push surface is in the use position and the push assembly is positioned forward of the retracted position.

2. The billiard ball rack of claim 1, wherein:

the push assembly includes a cross member that is slidably mounted to the support structure and moves linearly relative to the support structure.

3. The billiard ball rack of claim 2, wherein:

the push assembly includes a pair of push rods extending rearwardly of the rear member of the support structure, and wherein:

the two side members are connected to the rear member to define rear corner portions of the support structure, the support structure further including a pair of protrusions extending outwardly from the corner portions to form handles that can be grasped by a user while the user is pushing on the push rods.

4. The billiard ball rack of claim 2, wherein:

the cross member comprises a first cross member; and the second push surface is formed by a second cross member pivotably mounted to the support structure for rotation about a generally horizontal axis.

5. The billiard ball rack of claim 4, wherein:

the first and second push surfaces are substantially planar.

6. The billiard ball rack of claim 4, wherein:

the second cross member includes an elongated main body and a pair of pivot arms extending from the main body to the first cross member of the support structure and being pivotably connected to the first cross member.

7. The billiard ball rack of claim 6, wherein:

the push assembly includes a pair of pivot connectors pivotably interconnecting the first and second cross members, each pivot connector including an aperture and a pin rotatably received in the aperture, and wherein:

flexing of the pivot arms causes the pins to be removed from the apertures to thereby disconnect the second cross member from the first cross member.

8. The billiard ball rack of claim 7, wherein:

the support structure includes spaced-apart retaining surfaces adjacent the pivot connectors when the push assembly is in the retracted position;

the pivot arms have end portions positioned directly adjacent the retaining surfaces when the push assembly is in the retracted position, the retaining surfaces limiting the movement of the end portions of the pivot arms and preventing removal of the pins from the apertures.

9. The billiard ball rack of claim 1, wherein:

the side members of the support structure have lower surfaces configured to abuttingly support the billiard ball rack on a planar surface, and upper edges spaced approximately 1.125 inches apart from the lower surfaces adjacent the inner surface portions of the side members, such that in use the inner surface portions contact 2.25 inch diameter billiard balls adjacent a midline of the billiard balls, and wherein:

the billiard ball rack includes a generally V-shaped nine-ball adapter pivotably mounted to the support structure, the adapter including a pair of arms extending at about sixty degrees relative to one another wherein the adapter is pivotable between a forward position wherein the arms are parallel to the side members, and a rearward position wherein the arms extend at an angle relative to the side members to define a billiard ball-receiving space that is diamond-shaped in plan view, the arms of the adapter defining first and second opposite side faces that contact the upper edges of the side members when the adapter is in the forward position.

10. The billiard ball rack of claim 9, wherein:

the nine-ball adapter includes at least three pins extending inwardly towards the billiard ball-receiving space and at least three springs resiliently biasing the pins inwardly, wherein the amount of force generated by the pins when moved against the bias of the springs can be adjusted and set at a selected magnitude.

11. The billiard ball rack of claim 9, wherein:

the billiard ball rack defines an overall height that is less than about two inches when the nine-ball adapter is in the forward position such that the billiard ball rack can be inserted into a conventional rack storage cavity of a pool table.

12. The billiard ball rack of claim 9, wherein:

the billiard ball rack defines an overall height that is less than about two inches when the nine-ball adapter is in the rearward position such that the billiard ball rack can be inserted into a conventional rack storage cavity of a pool table.

13. The billiard ball rack of claim 9, wherein:

the support structure includes first and second openings in the side members;

the arms of the V-shaped nine-ball adapter have end portions with protrusions received in the nine-ball openings to pivotably mount the adapter to the support structure.

14. The billiard ball rack of claim 13, wherein:

at least one of the arms of the V-shaped nine-ball adapter can be flexed to remove a protrusion from an opening and disconnect the nine-ball adapter from the support structure.

15. A billiard ball rack kit for racking billiard balls in a plurality of different configurations for a plurality of different games, the configurations including at least eight-ball and nine-ball configurations, the billiard ball rack comprising:

a support structure having two side members and a rear cross member together defining, in plan view, a triangle-shaped billiard ball-receiving space at least about the size of fifteen standard pocket billiard balls having a diameter of about 2.25 inches that are arranged in a triangle configuration for a game of eight-ball;

a V-shaped nine-ball adapter configured to be pivotably yet releasably connected to the support structure for pivoting movement about a horizontal axis between a use position wherein the nine-ball adapter and the side members of the support structure together define a diamond-shaped billiard ball-receiving space, and a non-use position wherein the nine-ball adapter does not substantially alter the size and shape of the billiard ball-receiving space, and wherein the V-shaped nine-ball adapter includes two legs defining an angle of about 60° relative to one another in the use position, the non-use position, and while pivoting between the use and non-use positions; and a six-ball adapter configured to be releasably connected to the support structure to define, with the support structure, a triangle-shaped billiard ball-receiving space configured to receive six standard pocket billiard balls in a triangle configuration.

16. The billiard ball rack kit of claim 15, wherein:

the support structure includes a pivotable attachment structure for pivotably interconnecting the support structure and the nine-ball adapter and for pivotably interconnecting the support structure and the six-ball adapter.

17. The billiard ball rack kit of claim 16, wherein:

the attachment structure pivotably and slidably attaches the nine-ball adapter and permits fore-aft movement of the nine-ball adapter when the nine-ball adapter is in a use position.

18. The billiard ball rack kit of claim 17, wherein:

the attachment structure comprises a pair of elongated openings;

the nine-ball adapter having a pair of arms having pins adapted to be pivotably received in the openings.

19. The billiard ball rack kit of claim 18, wherein:

the arms can be flexed to remove the pins from the openings.

20. The billiard ball rack kit of claim 15, including:

a pusher bar slidably connected to the support structure to define a rear side of the triangle-shaped billiard ball-receiving space and for reciprocating movement, and wherein the pusher bar is biased forwardly.

21. The billiard ball rack kit of claim 15, including:

an eight-ball pusher bar movably mounted to a rear portion of the support structure for reciprocating fore and aft movement; and wherein:

the support structure includes outwardly extending protrusions adjacent rear corners of the triangle-shaped billiard ball-receiving space, the protrusions forming handles graspable by a user while pushing forward on the eight-ball pusher bar.

22. A billiard ball rack kit for racking billiard balls in a plurality of different configurations for a plurality of different games, the configurations including at least eight-ball and nine-ball configurations, the billiard ball rack comprising:

a support structure having two side members and a rear cross member together defining, in plan view, a triangle-shaped billiard ball-receiving space at least about the size of fifteen standard pocket billiard balls having a diameter of about 2.25 inches that are arranged in a triangle configuration for a game of eight-ball;

a V-shaped nine-ball adapter configured to be pivotably yet releasably connected to the support structure for movement between a use position wherein the nine-ball adapter and the side members of the support structure together define a diamond-shaped billiard ball-receiving space, and a non-use position wherein the nine-ball adapter does not substantially alter the size and shape of the billiard ball-receiving space;

a six-ball adapter configured to be releasably connected to the support structure to define, with the support structure, a triangle-shaped billiard ball-receiving space configured to receive six standard pocket billiard balls in a triangle configuration; and wherein:

the support structure includes a pivotable attachment structure comprising a pair of elongated openings for pivotably and slidably interconnecting the support structure and the nine-ball adapter for pivotably interconnecting the support structure and the six-ball adapter and permitting fore-aft movement of the nine-ball adapter when the nine-ball adapter is in a use position;

the nine-ball adapter having a pair of arms having pins adapted to be pivotably received in the openings, wherein the arms can be flexed to remove the pins from the openings; and including:

a pusher bar slidably connected to the support structure to define a rear side of the triangle-shaped billiard ball-receiving space and for reciprocating movement; and wherein the pusher bar is biased forwardly and wherein the pusher bar further comprises an eight-ball pusher bar and a ten-ball adapter bar pivotably connected to the eight-ball pusher bar, the ten-ball adapter bar movable from a use position defining, with the two side members, a triangle-shaped billiard ball-receiving space sized to receive ten standard size billiard balls, and a non-use position wherein the ten-ball adapter does not substantially define the billiard ball-receiving space.

23. The billiard ball rack kit of claim 22, wherein:

pivotable connectors releasably connecting the ten-ball pusher bar to the eight-ball pusher bar.

* * * * *